US010059494B2

(12) United States Patent
Ruggiero

(10) Patent No.: US 10,059,494 B2
(45) Date of Patent: Aug. 28, 2018

(54) MEMBRANE SEAL COMPRISING A LIQUID POUCH AND A RADIOFREQUENCY DEVICE FOR DETERMINING THE INTEGRITY OF THE SEAL

(71) Applicant: S4GV SA, Montagny-Yverdon (CH)

(72) Inventor: Pierre Ruggiero, Bogis-Bossey (CH)

(73) Assignee: S4GV SA, Montagny-Yverdon (CH)

( * ) Notice: Subject to any disclaimer, the term of this patent is extended or adjusted under 35 U.S.C. 154(b) by 0 days.

(21) Appl. No.: 15/066,474

(22) Filed: Mar. 10, 2016

(65) Prior Publication Data

US 2016/0264325 A1 Sep. 15, 2016

(30) Foreign Application Priority Data

Mar. 10, 2015 (FR) ..... 15 51980

(51) Int. Cl.
*G08B 21/00* (2006.01)
*B65D 55/02* (2006.01)
*B65D 55/06* (2006.01)

(52) U.S. Cl.
CPC ..... *B65D 55/028* (2013.01); *B65D 55/026* (2013.01); *B65D 55/066* (2013.01); *B65D 2203/10* (2013.01); *B65D 2203/12* (2013.01)

(58) Field of Classification Search
CPC ..... B65D 2203/10; B65D 2203/12; B65D 55/026; B65D 55/028; B65D 55/066
USPC ..... 340/540
See application file for complete search history.

(56) References Cited

U.S. PATENT DOCUMENTS 3,899,295 A * 8/1975 Halpern ..... A61L 2/28 101/491
4,502,605 A 3/1985 Wloszezyna
2003/0061706 A1* 4/2003 Smeyak ..... G06K 19/04 29/601
2004/0066296 A1* 4/2004 Atherton ..... G08B 13/2434 340/572.1
2005/0051624 A1* 3/2005 Kipp ..... B65D 51/24 235/385
2008/0021381 A1* 1/2008 Lurvey ..... A61M 39/02 604/85
2008/0252450 A1* 10/2008 Wandel ..... B65D 55/026 340/541
2017/0019754 A1* 1/2017 Wilkinson ..... H04B 5/0031

FOREIGN PATENT DOCUMENTS

FR 288001 A 6/2006
WO WO 2007/065196 A 6/2007

OTHER PUBLICATIONS

Search Report and Written Opinion issued by the French Patent Office for priority application FR 1551980 dated Jan. 5, 2016.

* cited by examiner

*Primary Examiner* — Mark Rushing
(74) *Attorney, Agent, or Firm* — Wissing Miller LLP

(57) ABSTRACT

The invention relates to a membrane seal (1) for a container (2) for products, for example a container for food products, cosmetic products, products for medical use, etc. The membrane seal comprises a control device and is configured to facilitate inventory management, authenticate contents, and protect against an ill-intentioned attempt to siphon the content stored in the container (2). The invention also relates to a stopper and a container provided with such a membrane seal.

12 Claims, 1 Drawing Sheet

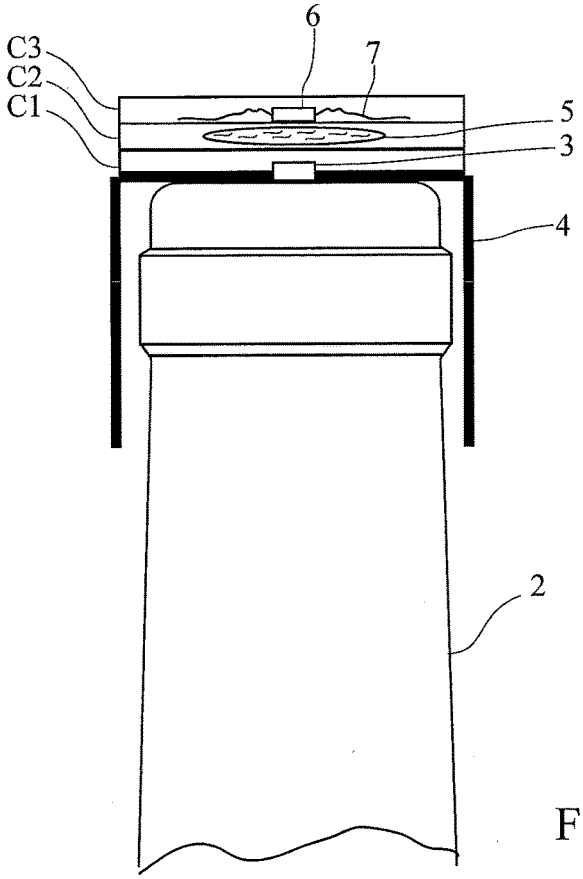
Fig.1
Fig.2
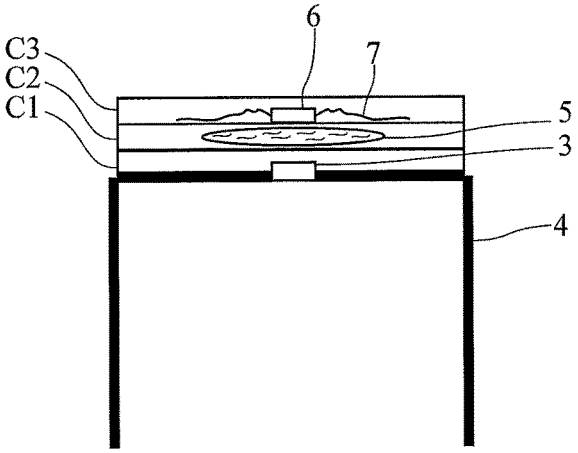
Fig.3
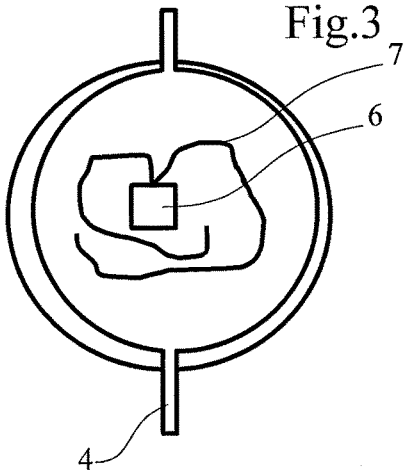

MEMBRANE SEAL COMPRISING A LIQUID POUCH AND A RADIOFREQUENCY DEVICE FOR DETERMINING THE INTEGRITY OF THE SEAL

TECHNICAL FIELD OF THE INVENTION

The invention relates to the packaging field. The invention in particular relates to a membrane seal for a container, for example a container for food products, cosmetic products, products for medical use, etc. The invention further pertains to a stopper and a container provided with such a membrane seal.

BACKGROUND OF THE INVENTION

Certain products are packaged in containers closed by a stopper, which sometimes tops a membrane seal. The presence of a membrane seal improves the storage duration of the product and indirectly certifies the authenticity of the contents to the consumer. Based on needs, membrane seals are made from flexible materials, and are sometimes formed by a stack of several layers secured to one another. Furthermore, the use of membrane seals in the context of authenticating contents implies that they are generally made from fragile materials, such that they must be irreparably damaged to access the product.

Some fraudulent operators, however, have used very fine syringes to siphon and replace the contents of certain containers without damaging the membrane seals. Membrane seals that do not protect against this type of manipulation are not fulfilling their role regarding the authentication of contents.

BRIEF DESCRIPTION OF THE INVENTION

The invention aims to resolve this drawback by providing a membrane seal that indicates whether contents stored in a container have been altered, and thus makes it possible for an end customer to authenticate a product.

The invention also aims to provide a membrane seal that performs several functions: a first logistical function, for example as part of an inventory management system, and a second securing function in order to, inter alia, prevent attempted security breaches, detect siphoning attempts of the contents.

These aims are achieved by a membrane seal comprising a control device, the control device being provided with communication means to send and receive radiofrequency signals and configured to determine the integrity of a first antenna, and a tight pouch containing a liquid or viscous substance.

According to one feature, the membrane seal can comprise a near field communication device comprising a second antenna.

According to another feature, the pouch can be made from a material less hard than steel.

According to another feature, the pouch can be made from a plastic material.

According to another feature, the thickness of the wall of the pouch can be less than 3 mm.

According to another feature, the substance may contain a dye or liquid invisible to the naked eye.

According to another feature, the pouch may extend over the entire surface of the membrane seal or over only part of the surface of the membrane seal.

According to another feature, the thickness of the membrane seal can be smaller than 1 mm.

According to another aspect of the invention, a stopper for a container comprises a membrane seal as described above.

According to another aspect of the invention, a container comprises a membrane seal as described above.

BRIEF DESCRIPTION OF THE FIGURES

Other features and advantages of the invention will emerge from reading the following description, in reference to the appended figures, which illustrate:

FIG. 1, a front diagrammatic view of a membrane seal according to the invention positioned at the apex of the neck of a bottle;

FIG. 2, a front sectional view of a membrane seal according to the invention;

FIG. 3, a top view of a membrane seal according to the invention.

DETAILED DESCRIPTION OF THE INVENTION

FIG. 1 shows a membrane seal 1 positioned on a container 2, in the present case a container for food products, in the case at hand a bottle intended to store a liquid or viscous food products. Although shown in FIG. 1 at the apex of the neck of a bottle 2, the membrane seal 1 according to the invention can be used with containers for all types of products, for example containers for cosmetic products, for products intended for medical use, irrespective of the form, i.e., a bottle, pots, jar, etc.

As is typical, the membrane seal 1 according to the invention can be glued, heat sealed, or simply placed at the apex of the container 2.

Alternatively, the membrane seal 1 according to the invention can be secured to or be an integral part of a stopper or cover intended to close a container.

The structure of the membrane seal 1 according to the invention is shown in FIG. 2. It assumes the form of a stack of several layers c1, c2 and c3 secured to one another.

A first of these layers c1 comprises a first circuit supporting a control device 3, including a transmitter and a receiver for radiofrequency signals and connected to a first antenna 4, preferably an antenna of the "Tamper Evident" type, which is designed so as to undergo irreversible damage in case of manipulation. The control device 3 is configured to determine the integrity of the first antenna 4 and, if the integrity of the antenna is altered, to act by emitting a specific radiofrequency signal and/or modifying configuration data specific to it.

The control device 3 is able to emit radiofrequency signals when it is stimulated by a reader that supplies it with power. Based on the needs, the control device 3 is designed such that the signals that it emits can be picked up several tens of centimeters away, or even several tens of meters away. Preferably, the control circuit 3 comprises a second antenna (not shown). Such a device is therefore appropriate for being used within an automated inventory management system.

A second layer c2 of the membrane seal 1 comprises a tight pouch 5 containing a liquid or viscous substance. Preferably, the substance contains a dye visible to the naked eye. Alternatively, the substance contains a dye not visible to the naked eye, but which can be revealed using an appropriate device.

Preferably, the pouch 5 is flexible and is made from plastic. Alternatively, the pouch 5 is made from a material less hard than steel. Preferably, the thickness of the wall of the pouch 5 is smaller than 3 mm.

Preferably, the pouch 5 is flexible over the entire surface of the membrane seal 1. Alternatively, the pouch 5 extends over only part of the surface of the membrane seal 1.

A third layer c3 of the membrane seal 1 comprises a second circuit supporting a near field communication (NFC) device 6 appropriate for communicating with a mobile device, for example a smartphone. Preferably, the near field communication device 6 includes a third antenna 7. The near field communication device 6 is thus configured, inter alia, to communicate with a mobile device in order to allow the authentication of the product at a point-of-sale by a consumer.

Once it is positioned on a container, the membrane seal according to the invention makes it possible to determine whether the contents stored inside the container have been modified using a syringe. In fact, if a syringe is inserted through the stopper, the pouch 5 is pierced and the substance contained within the pouch 5 is released.

Furthermore, the first antenna 4 being designed such that it does not withstand an attempt to remove the membrane seal, if anyone tries to remove the membrane seal 1, the antenna 4 is altered and the control device 3, which is configured to monitor the integrity of the antenna 4 constantly, emits a specific radiofrequency signal that can be received and interpreted by an appropriate computer system and/or modifies configuration data specific to it.

Although the structure of the membrane seal has been described as comprising several stacked layers, the structure may alternatively, inasmuch as all of the elements described above are present, include a different number of layers. Likewise, the arrangement of the layers c1, c2 and c3 making up the membrane seal 1 can be different from that shown in FIGS. 1-3.

Preferably, the thickness (e) of the membrane seal according to the invention is smaller than 1 mm. Alternatively, the thickness of the membrane seal 1 is smaller than 5 mm.

The invention claimed is:

1. A membrane seal for a container comprising:

a first layer;

a second layer;

a control device located in the first layer, the control device being provided with communication means to send and receive radiofrequency signals and configured to determine the integrity of a first antenna;

a continuous material shaped as a tight pouch located in the second layer, the tight pouch containing a liquid or viscous substance comprising a dye that is released when the tight pouch is pierced;

a third layer; and a near field communication device comprising a second antenna, wherein the near field communication device is located in the third layer, and wherein the first, second and third layer are stacked on top of each other.

2. The membrane seal according to claim 1, wherein the pouch is made from a material pierceable by a steel syringe needle.

3. The membrane according to claim 1, wherein the pouch is made from a plastic material.

4. The membrane seal according to claim 1, wherein the thickness of the wall of the pouch is less than 3 mm.

5. The membrane seal according to claim 1, wherein the substance contains a dye or liquid invisible to the naked eye.

6. The membrane seal according to claim 1, wherein the pouch extends over the entire surface of the membrane seal or over only part of the surface of the membrane seal.

7. The membrane seal according to claim 1, wherein its thickness is smaller than 1 mm.

8. A stopper for a container, wherein it comprises a membrane seal according to claim 1.

9. A container, which comprises a membrane seal according to claim 1.

10. The membrane seal according to claim 1, wherein the control device sends radiofrequency signals in response to a change in the determined integrity.

11. The membrane seal according to claim 1, wherein the tight pouch is in the shape of a capsule or bag.

12. The membrane seal according to claim 1, wherein the second layer is located on top of the first layer;

the third layer is located on top of the second layer; and wherein the first layer is configured to contact a container.

* * * * *